United States Patent [19]

Immel

[11] 4,274,167

[45] Jun. 23, 1981

[54] OSCILLATING BED

[76] Inventor: Joseph D. Immel, 4809 Green Acres Rd., St. Joseph, Mo. 64506

[21] Appl. No.: 71,689

[22] Filed: Aug. 31, 1979

[51] Int. Cl.[3] ..... A62G 7/10

[52] U.S. Cl. ..... 5/62; 5/66; 128/33

[58] Field of Search ..... 5/60, 62, 63, 66, 67, 5/68, 81 R; 128/33, 32, 36

[56] References Cited

U.S. PATENT DOCUMENTS

| | | | |
|---|---|---|---|
| 2,693,796 | 11/1954 | Warner | 128/33 |
| 3,015,330 | 1/1962 | Linstrom | 128/33 |
| 3,277,736 | 10/1966 | Goodman | 5/68 |
| 3,609,779 | 10/1971 | Oja et al. | 5/62 |
| 3,752,154 | 8/1973 | Clark | 128/33 |
| 3,997,926 | 12/1976 | England | 5/62 |

*Primary Examiner*—Casmir A. Nunberg
*Attorney, Agent, or Firm*—Harvey B. Jacobson

[57] ABSTRACT

A substantially planar platform having a mattress supported thereon is pivotally attached toward one end to a framework. A bed support structure has a pair of arcuate surfaces which engage the lower face of the platform. The arcuate surfaces are attached to a pair of channel bars which are supported on wedge-shaped elements. The channel bars are pivoted on a common axis and the wedge-shaped elements are moved forwardly by a screw and follower mechanism thereby pivoting the channel bars to move the arcuate supports upwardly against the bottom of the platform. This pivots the platform upwardly. The pivot axis of the channel comprises a tube mounted on an eccentric shaft. The eccentric shaft is rotated under power thereby causing vibration of the entire mechanism resulting in oscillatory motion to relieve stress, strain and tension in the user and aid in the treatment of back and circulatory ailments.

11 Claims, 6 Drawing Figures

OSCILLATING BED

BACKGROUND OF THE INVENTION

1. Field of the Invention

This invention relates to therapeutic beds and especially to such beds which are adapted to both tilt and vibrate in order to provide treatment of circulatory problems.

2. Description of Related Art

It has been known for many years to employ oscillatory motion in the treatment of back, spine and muscle ailments. For instance, U.S. Pat. No. 835,622, issued Nov. 13, 1906, to Kellogg, shows a movement cure apparatus comprising a seat or chair mounted on resilient feet. A shaft is supported by the seat with a weight mounted on the shaft together with means for adjusting the weight. U.S. Pat. No. 1,797,306, issued Mar. 24, 1931, to Webb, shows a massaging and vibrating machine having a rectangular framework adapted to support in a resilient manner a framework having a tautly stretched member thereon. A rotatable shaft with unbalanced weights fixedly mounted to it is secured for rotation on the resiliently mounted framework and a motor is connected to the shaft to produce vibrations. U.S. Pat. No. 2,674,993, issued Apr. 13, 1954, to Harrell, shows a vibrating board comprising a rectangular base member and an electric motor rigidly attached to the bottom of the base member. The motor has eccentrics on its shaft for producing vibrations in the board. Straps are attached to the top of the board for holding a person.

Furthermore, beds have been suggested which include tilting or bending portions to provide a more comfortable position for a person to lie in. Also, the change in position has therapeutic value. U.S. Pat. No. 1,037,419, issued Sept. 3, 1912, to Bosanko, shows two angularly movable pairs of arms operative to raise and support a bed spring and a hand crank operative to move the arms. Adjustable stops are connected to the side rails of the spring with each pair of arms carrying devices that lie under and fit up against the side rails of the frame. U.S. Pat. No. 3,611,453, issued Oct. 12, 1971, to Lokken, shows an invalid bed and tilt actuating mechanism comprising a pair of scissor arms wherein movement of the frame is effected by buckling of the scissors upon which a patient supporting frame rests. Buckling is normally prevented by at least one butterfly arm pivotally carried by one longitudinal member of the patient supporting frame. U.S. Pat. No. 3,802,002, issued Apr. 9, 1974, to Jonas, shows a hospital bed in which the legs at each end of the bed are connected by a cross member so that the legs can pivot together to adjust the height of the bed from the floor. U.S. Pat. No. 3,997,926, issued Dec. 21, 1976, to England, shows a bed with automatic occupant tilting support. The England bed comprises an elongated leg supported framework and a flat rigid occupant support platform mounted for pivotal movement between a horizontal position and an upright position. A screw shaft is connected between a nut pivotally mounted to the framework and a bracket mounted to the underside of the occupant support platform.

Finally, beds have also been suggested which include tilting devices and vibration producing mechanisms. One example of such a bed can be seen in U.S. Pat. No. 3,042,025, issued July 3, 1962, to Jackson. The Jackson apparatus includes an elongated sectional and foldable frame in which the sections are hingedly joined for movement between extended and folded positions. The frame provides, when extended, an elevated intermediate portion and a downwardly inclined portion extending from the elevated portion so as to rest upon a floor or other surface. A device for vibrating the frame is carried by the elevated portion.

SUMMARY OF THE INVENTION

One object of the present invention is to provide an oscillating bed having a patient supporting platform which can easily be tilted to any number of inclined positions.

A further object of the present invention is to provide an oscillating having a patient supporting platform which platform can be caused to oscillate in a vibratory manner to facilitate the treatment of back and circulatory ailments.

Yet another object of the present invention is to provide an oscillating bed wherein the tilting and oscillating functional components are related so as to reduce the weight being raised and produce equal oscillatory motion to the patient supporting platform at any angle of inclination.

A further additional object of the present invention is to provide an oscillating bed wherein the tilting and oscillating movements can be produced by motors mounted on a main frame.

Another object of the present invention is to provide an oscillating bed which provides secure support for a patient in order to insure the patient's safety when the bed is in a raised or inclined position.

In accordance with the above objects, the present invention comprises a main upstanding frame having a patient supporting platform mounted thereon for movement about a horizontal pivot axis disposed at one end of the frame. A platform support frame comprises a pair of channel irons mounted at one end to a pivot tube. The channel members open downwardly and have arcuate shaped platforming engaging members mounted on their top surfaces for supporting the platform in an inclined position. The pivot tube is mounted on an eccentric support shaft which is disposed for rotation within the pivot tube. A pair of triangular blocks are disposed beneath the channel irons and connected to a common follower of a screw and follower mechanism. As the screw is turned, the triangular blocks move forwardly under the channel irons and cause them to pivot upwardly pushing the arcuate support members against the bottom of the platform causing it to pivot upwardly also. The eccentric shaft can be rotated by an electric motor thereby causing the platform to vibrate through the channel irons and arcuate support structure.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
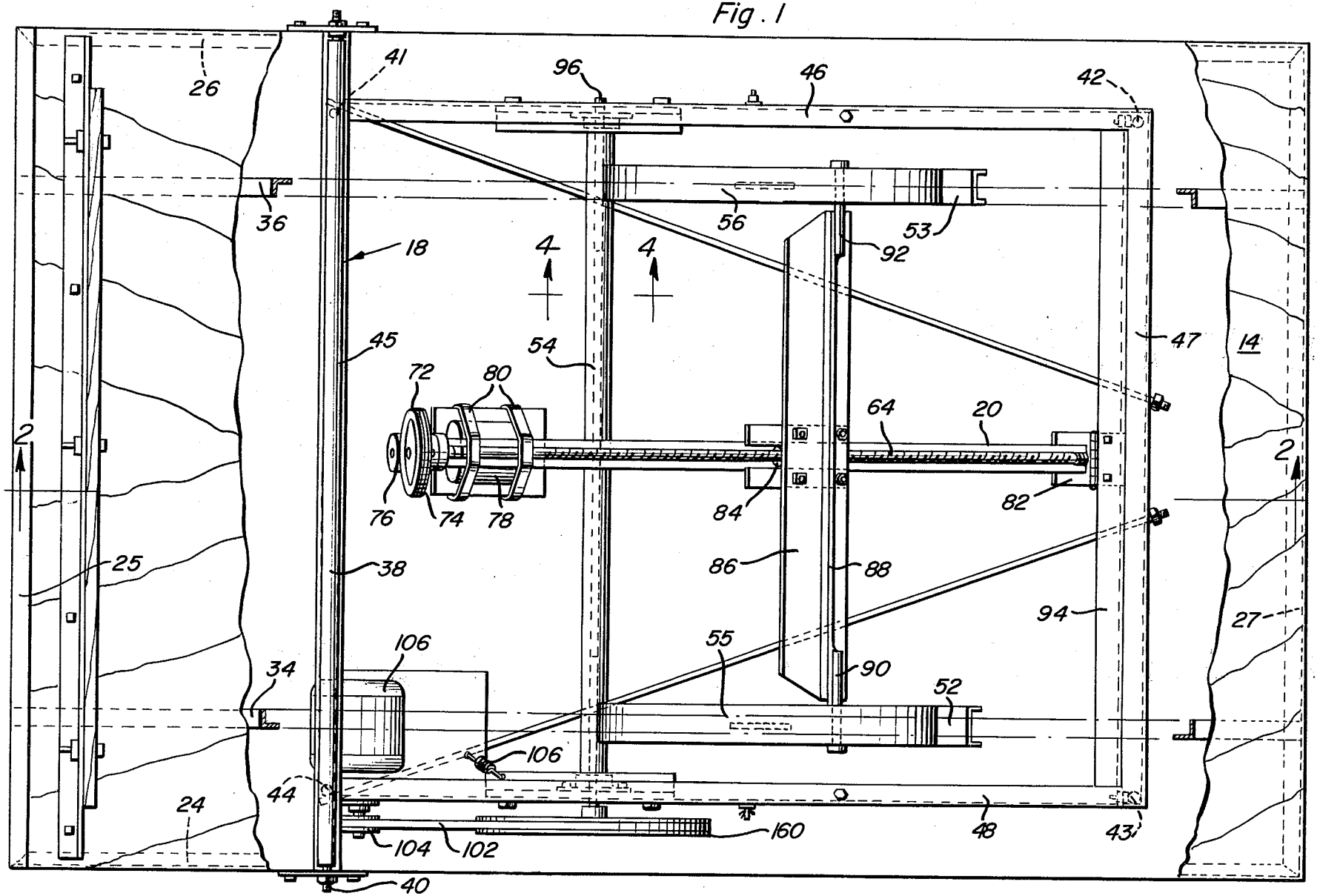
FIG. 1 is a partial fragmentary plan view of the oscillating bed.

Now with reference to the drawings, an oscillating bed incorporating the principles and concepts of the present invention and generally referred to by the reference numeral 10 will be described in more detail. With specific reference to FIGS. 1 and 2, it will be seen that the bed 10 includes a patient supporting platform 12 which may have a mattress 14 mounted thereon. The platform is attached to an upstanding frame 16 at pivot joint 18. The mattress and platform can pivot between a horizontal position shown in solid lines in FIG. 2 and an inclined position shown in phantom in FIG. 2 at 12'. A lifting frame 20 is pivotally mounted at pivot joint 22 and is urged against the bottom of the platform 12 to swing that platform upwardly to position 12'. The pivot joint 22 includes an inner eccentric shaft which constitutes the vibration producing mechanism as will be discussed further hereinafter.

Figure 2:
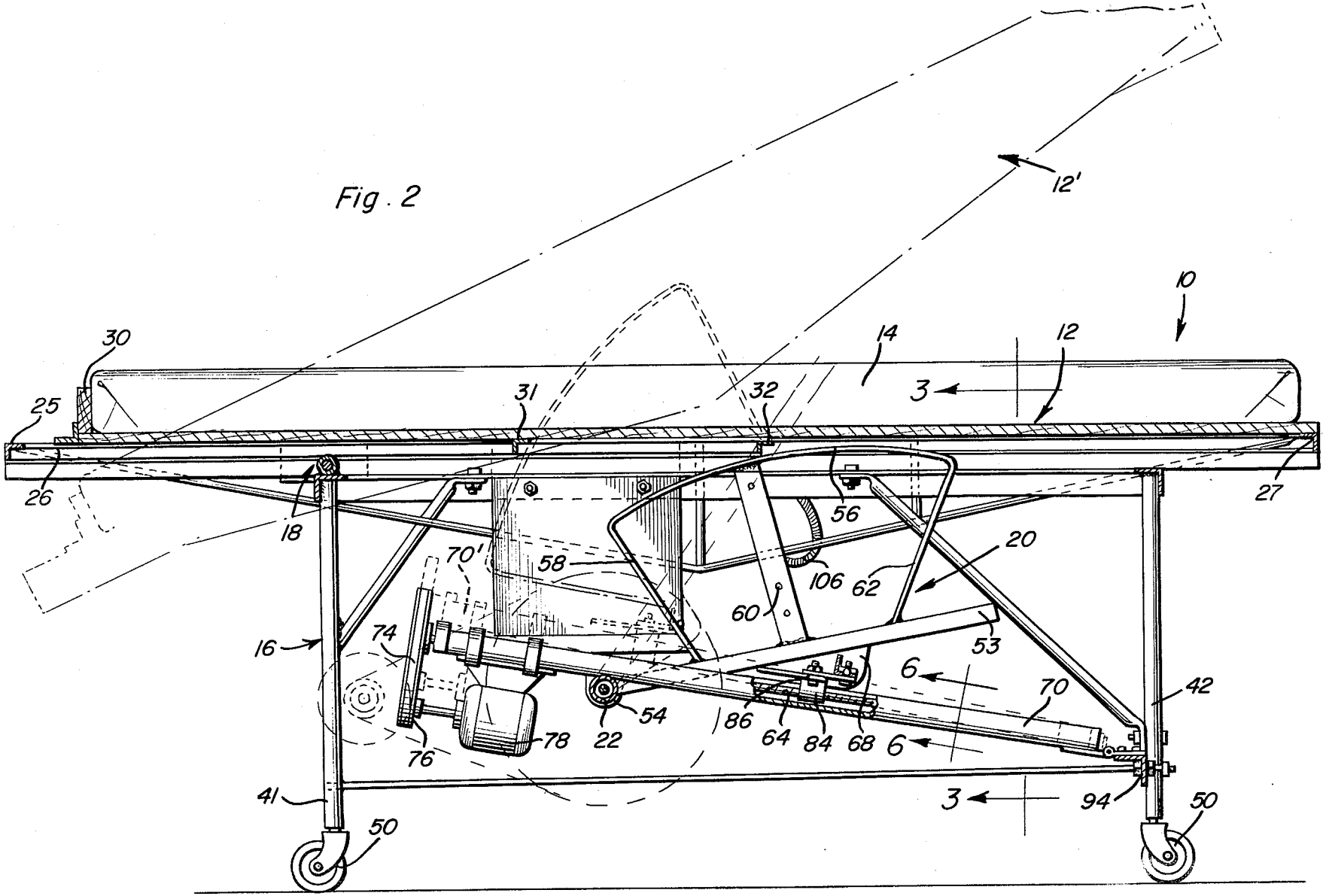
FIG. 2 is an elevational sectional view taken substantially along a plane passing through section line 2—2 of FIG. 1.
Figure 3:
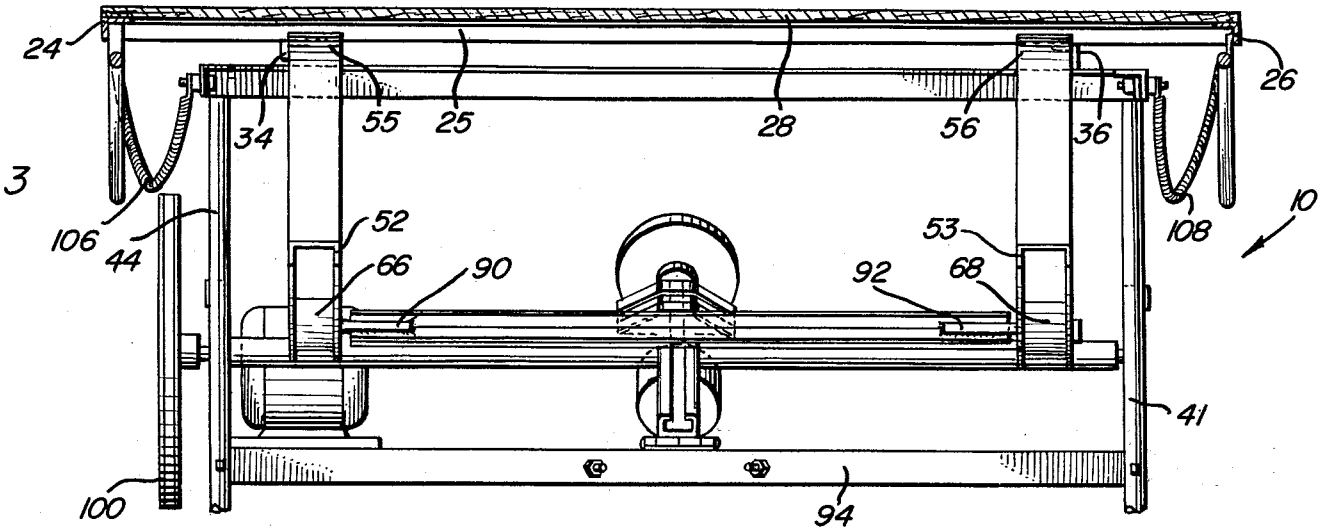
FIG. 3 is an end elevational sectional view taken substantially along a plane passing through section line 3—3 of FIG. 2.
Figure 6:
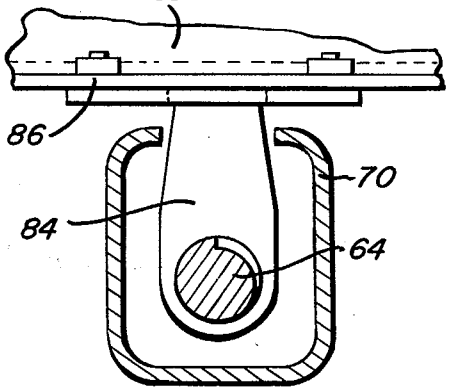
FIG. 6 is an elevational sectional view taken substantially along a plane passing through section line 6—6 of FIG. 2.
Figure 5:
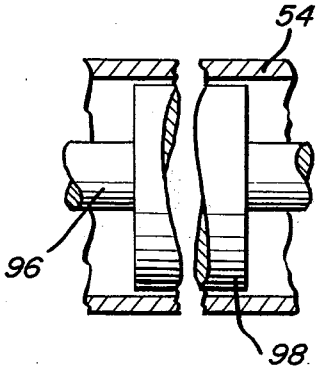
FIG. 5 is a sectional view taken substantially along a plane passing through section line 5—5 of FIG. 4.
Figure 4:
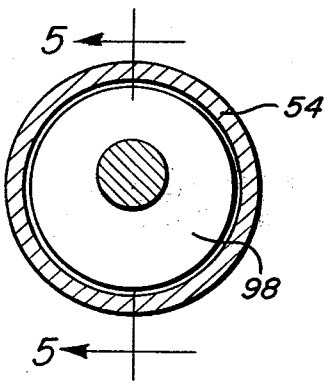
FIG. 4 is an elevational sectional view taken substantially along a plane passing through section line 4—4 of FIG. 1 showing the pivot bar and eccentric shaft connection.

The platform 12, as seen in FIGS. 1 through 3, includes a generally rectangular steel framework comprising angle sections 24, 25, 26 and 27. This frame is fixedly attached to a planar section 28, which can be wood or any other suitable material and which is connected to the frame by screws, bolts, glueing, or any other suitable fastening device. The planar section 28 includes, at its lower end, an upright support 30 which holds mattress 14 in position. Support 30 can be extended to engage the feet of the user, if desired. Any other suitable means may be also used for holding the user in position on the mattress. Two cross members 31 and 32 are also angle sections which extend between angle sections 24 and 26 to provide extra support for the platform frame. Two more angle sections 34 and 36 run longitudinally of the platform 12 and provide support surfaces which engage with the lifting frame 20 to raise the platform about pivot joint 18. Pivot joint 18 includes a pivot tube 38, which is fixedly attached to the frame 16, and a spindle 40, which passes through the pivot tube 38 and is fixedly attached to angle bars 24 and 26.

The frame 16 includes four upright legs 41, 42, 43 and 44 to which are welded four interconnecting angle sections 45, 46, 47 and 48, and the pivot tube 38 is welded to angle section 45. Each leg also contains a caster wheel 50 attached to its bottom for supporting the entire bed on an appropriate support surface for allowing mobility thereof. Further braces and support bars can be attached between portions of the frame 16 to provide proper rigidity thereto as would be obvious to one of ordinary skill in the art.

The lifting frame 20 comprises a pair of downwardly opening channel bars 52 and 53 which are attached at one end to a pivot tube 54 as by welding or any other suitable attachment mechanism. The channel bars 52, 53 are connected respectively to arcuate platform support bars 55, 56, each of which is welded to three legs extending between the associated channel bars, as shown in FIG. 1 with respect to arcuate support 56 and labelled 58, 60 and 62. The arcuate support surfaces 55, 56 engage with aforementioned angle sections 34 and 36. When lifting frame 20 pivots about pivot tube 54, the arcuate sections 55, 56 slide along angle sections 34 and 36, respectively, urging the platform 12 up into an inclined position.

The lifting frame 20 is pivoted by virtue of a screw and follower mechanism comprising threaded shaft 64, as seen in FIGS. 1 through 3 and 6, and triangular blocks 66 and 68 which are disposed on either side of the shaft. The shaft 64 is rotatably mounted in a housing 70 and has connected on one end thereof a shaft pulley 72. Shaft pulley 72 is driven through belt 74 and drive pulley 76 by the drive motor 78. The motor 78 is attached to the housing 70 through straps 80. The housing 70 is pivotally mounted to frame 16 by hinge 82. When the platform 12 is in the horizontal position, the housing 70 rests upon pivot tube 54 as shown in solid lines in FIG. 1. A threaded follower 84 rides upon threaded shaft 64 and moves longitudinally thereof with rotation of the shaft being caused by motor 78. A plate 86 is attached to the top of follower 84 by means of bolts, or any other suitable attachment mechanism. Plate 86 has an angle section 88 mounted on top of it to provide rigidity thereto. At the ends of the plate 86 are a pair of spindles 90 and 92 which are welded to the plate 86. Spindles 90 and 92 rotatably mount the triangular blocks 66 and 68 by passing through the centers of those blocks. Accordingly, it can be seen that since the lower end of the threaded screw 64 is mounted through hinge 82 to support bar 94 and that support bar is mounted on frame 16 below the position to pivot tube 54, as the screw 64 is turned by motor 78, the follower 84 will advance longitudinally along the screw pulling the blocks 66 and 68 with it. These blocks ride in the downwardly opening channel bars 52 and 53 and accordingly urge these channel bars upwardly pivoting them and the pivot tube 54. Naturally, the arcuate supports 55 and 56 are urged upwardly also and push against the angle sections 34 and 36 mounted on the platform 12, thereby pivoting the platform about its pivot joint 18. As the triangular blocks 66 and 68 advance along the channel bars 52 and 53, their angular position changes about spindles 90 and 92 keeping their top surfaces parallel to the associated channel bars. The blocks finally abut against pivot tube 54 when the platform has been raised approximately two feet. Once the blocks abut against the pivot tubes, their forward motion stops and they begin to pivot about the tube 54 and raise the screw and the follower mechanism, as shown in phantom in FIG. 2 and labelled 70'. In this manner, the bed can be tilted to any desired angle with the length of the threaded shaft 64 being kept to a minimum and without fear of the screw and follower mechanism hitting the bottom of the platform 12 since the platform will be tilted out of the way before the screw and follower mechanism ever reaches the top of the frame 16.

As seen in FIGS. 1 through 4 and 6, the pivot tube 54 is mounted on a shaft 96, the ends of which are supported and journaled in bearings which are affixed to the frame 16. The center of shaft 96, as shown at 98, is eccentric and totally supports the pivot tube 54. Accordingly, the pivot tube can pivot about the eccentric 98 to raise and lower the platform. At the same time, shaft 96 can rotate within tube 54 with the eccentric 98 causing a vibration thereof. One end of the shaft 96 has a shaft pulley 100 mounted thereto. Pulley 100 is driven through belt 102 and drive pulley 104 by motor 106. Accordingly, when motor 106 is actuated, shaft 96 rotates in the pivot tube causing eccentric motion thereof. This eccentric or oscillatory motion is transmitted to the platform 12 through the lifting frame 20 and finally to the patient. Since the shaft 96 serves to support most of the weight of the platform 12 when the platform is in its tilted position, the vibration produced by the eccentric portion of the shaft can be readily seen to cause an effective and therapeutic oscillatory motion of the platform in the form of vibrations.

Suitable harnesses for holding the patient on the platform itself can be provided in the form of straps or the like, as desired. Furthermore, safety features including springs 106 and 108 which are attached between the platform 12 and the frame 16 serve to insure that the platform will not tip over under its own weight and will be maintained in constant contact with the arcuate support surfaces when it is being tilted.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a therapeutic bed, the combination of:

a bed support frame having ground engaging legs;

a platform for supporting a user of the bed; said platform having a pivot joint connected toward one end thereof, said pivot joint also being connected to said bed support frame for allowing said platform to pivot about a horizontal axis to a plurality of inclined positions;

a lifting mechanism engaged with said platform and including lifting means for raising said platform to one of said inclined positions;

an eccentric shaft mounting said lifting mechanism, said lifting mechanism including at least one arcuate support slidably engaging the bottom of said platform and connected for rotative movement about said eccentric shaft for raising said platform; and power means for rotating said eccentric shaft to cause vibratory motion of said lifting mechanism and said platform.

2. The therapeutic bed defined in claim 1 and further wherein said lifting mechanism includes a downwardly facing channel member having said arcuate support connected to the top thereof and having one end connected for pivotal movement about said shaft.

3. The therapeutic bed defined in claim 2 and further wherein said lifting mechanism includes a rotatable screw, a follower means mounted on said screw for longitudinal movement therealong upon rotation of said screw and a block mounted to said follower means and slidably disposed beneath the channel member.

4. The therapeutic bed defined in claim 2 and further wherein said lifting mechanism includes a second power means connected to said screw for causing powered rotation thereof.

5. In a therapeutic bed, the combination of:

a bed support frame having ground engaging legs;

a platform for supporting a user of the bed, said platform having a pivot joint connected toward one end thereof, said pivot joint also being connected to said bed support frame for allowing said platform to pivot about a horizontal axis to a plurality of inclined positions;

an eccentric shaft mounting said lifting mechanism, said lifting mechanism including a tube mounted on said eccentric shaft with said tube supporting said platform when said platform is in an inclined position, said lifting mechanism further including an elongated guide member attached to and extending radially away from said tube, and a raising block means slidably disposed on said guide member, and movement means for moving said block means relative to said guide member thereby pivoting said guide member and said tube; and power means for rotating said eccentric shaft to cause vibratory motion of said lifting mechanism and said platform.

6. A therapeutic bed for inclining and vibrating a user disposed thereon, said bed comprising:

user support means for supporting a body of a user;

lifting means for lifting said user support means to an angular inclination; and vibration producing means comprising a rotatable eccentric shaft, said lifting means including a tube mounted on said eccentric shaft with said tube supporting said user support means when said user support means is in an inclined position, said lifting means further including an elongated guide member attached to and extending radially away from said tube, and a raising block means slidably disposed on said guide member, and movement means for moving said block means relative to said guide member thereby pivoting said guide member and said tube.

7. The therapeutic bed defined in claim 6 wherein said lifting means further includes a lifting frame mounted to said tube and rotatable with said tube; a screw and the follower mechanism slidably engaging said lifting frame.

8. The therapeutic bed of claim 7 wherein said screw and the follower mechanism includes a threaded shaft, a threaded nut on said shaft, and a block rotatably connected to said threaded nut, said block being slidably disposed against said lifting frame.

9. The therapeutic bed of claim 8 wherein said block is positioned to engage said tube at one limit of travel.

10. The therapeutic bed of claim 6 wherein said user support means comprises a substantially planar support surface.

11. The therapeutic bed of claim 10 wherein said planar support surface is generally rectangular in shape.

* * * * *